US005784788A

United States Patent [19]

Cothery

[11] Patent Number: 5,784,788

[45] Date of Patent: Jul. 28, 1998

[54] CUTTING TOOL FOR REMOVING A SEALANT SURROUNDING A VEHICLE WINDSHIELD

[75] Inventor: Jeffrey R. Cothery, Southfield, Mich.

[73] Assignee: Reid Manufacturing, Southfield, Mich.

[21] Appl. No.: 812,439

[22] Filed: Mar. 6, 1997

[51] Int. Cl.[6] ..... B26B 5/00

[52] U.S. Cl. ..... 30/294; 30/340; 279/79

[58] Field of Search ..... 30/294, 169, 339, 30/340; 279/76, 77, 79

[56] References Cited

U.S. PATENT DOCUMENTS

| | | | |
|---|---|---|---|
| 740,087 | 9/1903 | Carleton | 30/169 |
| 1,627,515 | 5/1927 | Laird | 30/169 |
| 2,396,866 | 3/1946 | Lytton | 279/79 X |
| 3,195,232 | 7/1965 | Toth | 30/169 |
| 3,673,383 | 6/1972 | Sofia | 30/169 X |
| 3,750,283 | 8/1973 | Hoffman | 30/339 X |
| 3,845,554 | 11/1974 | Joanis et al. | 30/339 X |
| 4,080,734 | 3/1978 | Barbour . | |
| 4,481,059 | 11/1984 | Steck . | |
| 4,694,576 | 9/1987 | Cothery . | |
| 4,700,478 | 10/1987 | Mezger et al. . | |
| 4,819,531 | 4/1989 | Lawhon . | |
| 5,309,805 | 5/1994 | Mezger et al. . | |
| 5,479,689 | 1/1996 | Schmit et al. . | |

*Primary Examiner*—Douglas D. Watts

*Attorney, Agent, or Firm*—Gifford, Krass, Groh, Sprinkle, Patmore, Anderson & Citkowski, P.C.

[57] ABSTRACT

A cutting tool for piercing a sealant surrounding a vehicle windshield including a cylindrically shape body which is internally hollowed and first and second blade housing members which, upon assembly, are axially slidably mounted within a first selected end of the body and form a blade receiving cavity. A blade includes a first insertable portion with at least one aperture and a second cutting portion extending at a desired angle with respect to the insertable portion. A spring loaded tang is mounted within the second blade housing member and is upwardly biased so that an upwardly projecting button portion engages through the at least one aperture of the blade insertable portion in a first blade retaining position. An inwardly displaceable disengaging member is axially slidably mounted within a second selected end of the body and is contoured along a forward face so that it unseats the spring loaded from the blade aperture in a second blade release position.

11 Claims, 2 Drawing Sheets

CUTTING TOOL FOR REMOVING A SEALANT SURROUNDING A VEHICLE WINDSHIELD

BACKGROUND OF THE INVENTION

1 Field of the Invention

The present invention relates generally to tools for removing a sealant surrounding a vehicle windshield and, more particularly, to a cutting tool having a quick blade release for removing such a vehicle sealant and which is further capable of exerting a maximum degree of force in use.

2. Description of the Prior Art

Numerous types of tools are known in the art for assisting an individual in removing a sealant which surrounds a vehicle windshield. An example of such a tool is illustrated in U.S. Pat. No. 4,694,576, issued to Cothery, which teaches a windshield sealant removal tool including a handle, an elongated member with a longitudinal bore extending partially therethrough and a removable and replaceable blade which is frictionally fitted to the end of the elongated member. The blade has a substantially U-shape in cross section and facilitates the cutting and removal of a channel within a urethane sealant surrounding the vehicle windshield.

A further example of a removal tool is shown in U.S. Pat. No. 4,481,059, issued to Steck, where the tool likewise includes a handle portion and a wire portion which extends from the handle portion. The tool is equipped with guide surfaces to facilitate the location of the wire into its trough and lock nut means for anchoring a free end of the wire at a location convenient to the guiding action of the guide surfaces.

Additional cutting knife assemblies are further illustrated in U.S. Pat. Nos. 4,700,478 and 5,309,805, both issued to Mezger et al., which teach knife assemblies which can be mounted to the end of conventional oscillating tools to facilitate the removal process. In each case, the knife blade must be secured in place by a fastener and an additional tool is required for removal and replacement of the blade. U.S. Pat. No. 4,819,531, issued to Lawhon, teaches a cutting tool having a blade mounted to a handle portion and further incorporating a winch assembly for successively drawing the blade through a sealant and across a length of the windshield as the handle is successively ratcheted.

U.S. Pat. No. 4,080,734, issued to Barbour, illustrates a yet further example of a tool for removing a vehicle windshield and includes a percussion tool with a shank and a pair of generally planar wing portions having blade portions extending in a generally L-shape. The arrangement of the shank and blade portions permit a selected blade to underlie an edge of a windshield during removal. The shank portion is connected to a pneumatically operated power tool which is employed to cut the sealant.

SUMMARY OF THE PRESENT INVENTION

The present invention is a cutting tool for piercing a sealant surrounding a vehicle windshield and includes an internally hollowed body having a desired thickness and length. The body is preferably cylindrically shaped and is constructed of a hardened and impact resistant material such as a lightweight metal or durable plastic. First and second blade housing members are provided as mating portions and are axially slidably mounted within a selected open end of the body. The assembled blade housing members form, in combination, an internal cavity for receiving a first insertable portion of a blade member. At least one aperture is formed in the first insertable portion and a second cutting portion of the blade extends from the cavity in a desired orientation relative to the body.

A gripping handle portion is mounted to a first end of an elongated stem portion and an opposite end of the stem portion is in turn pivotally secured to the body in proximity to the blade housing members. The gripping handle permits the user to apply both hands and, by doing so, exert a maximum degree of force to the sealant or like material being pierced in a relatively safe manner and without the need of powered machinery or such other facilitating sealant removal steps as heating the blade portion to an elevated temperature.

The cutting blade is capable of being quickly ejected and replaced from the body and this is provided for by a disengaging member axially slidably mounted within an opposing end of the body. The disengaging member has a desired thickness and is contoured along an inner facing side so that, upon being depressed inwardly, it deflects a spring loaded tang in a downward direction so that a button member formed with the tang unseats from within the at least one aperture in the blade insertable portion and permits the blade to slidably disengage from within the body. The ability to quickly remove and replace the cutting blade without the need of additional tools and fasteners is particularly desirable since a number of blades are normally employed during the removal of a typical windshield.

BRIEF DESCRIPTION OF THE DRAWINGS

Reference will now be had to the attached drawings, when read in combination with the following specification, wherein like reference numerals refer to like parts throughout the several views, and in which.

DESCRIPTION OF THE PREFERRED EMBODIMENT

Figure 1:
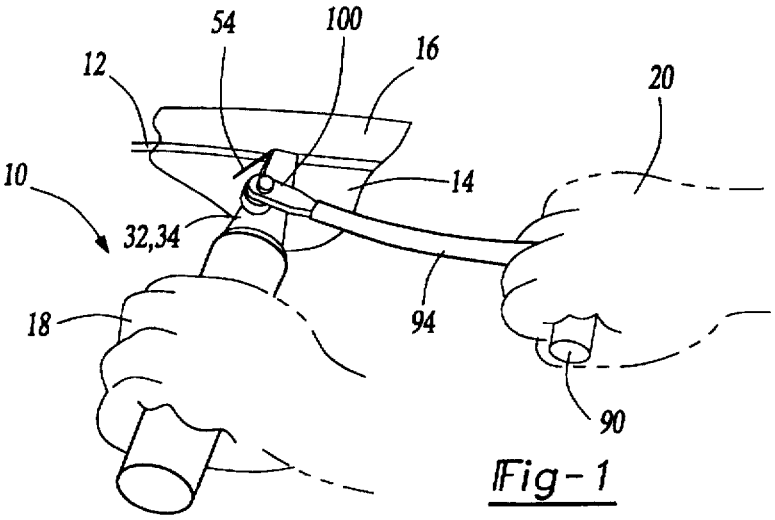
FIG. 1 is a view of the cutting tool in use according to the present invention.

Referring now to FIG. 1, a cutting tool 10 is shown in a use position according to the present invention for piercing a urethane sealant 12 surrounding a conventional vehicle windshield 14 and separating the windshield from a surrounding portion 16 of the vehicle body. As is best shown in FIG. 1, a user of the tool 10 can employ both hands 18 and 20 during the sealant piercing step in order to apply a maximum degree of force to the tool 10.

Figure 2:
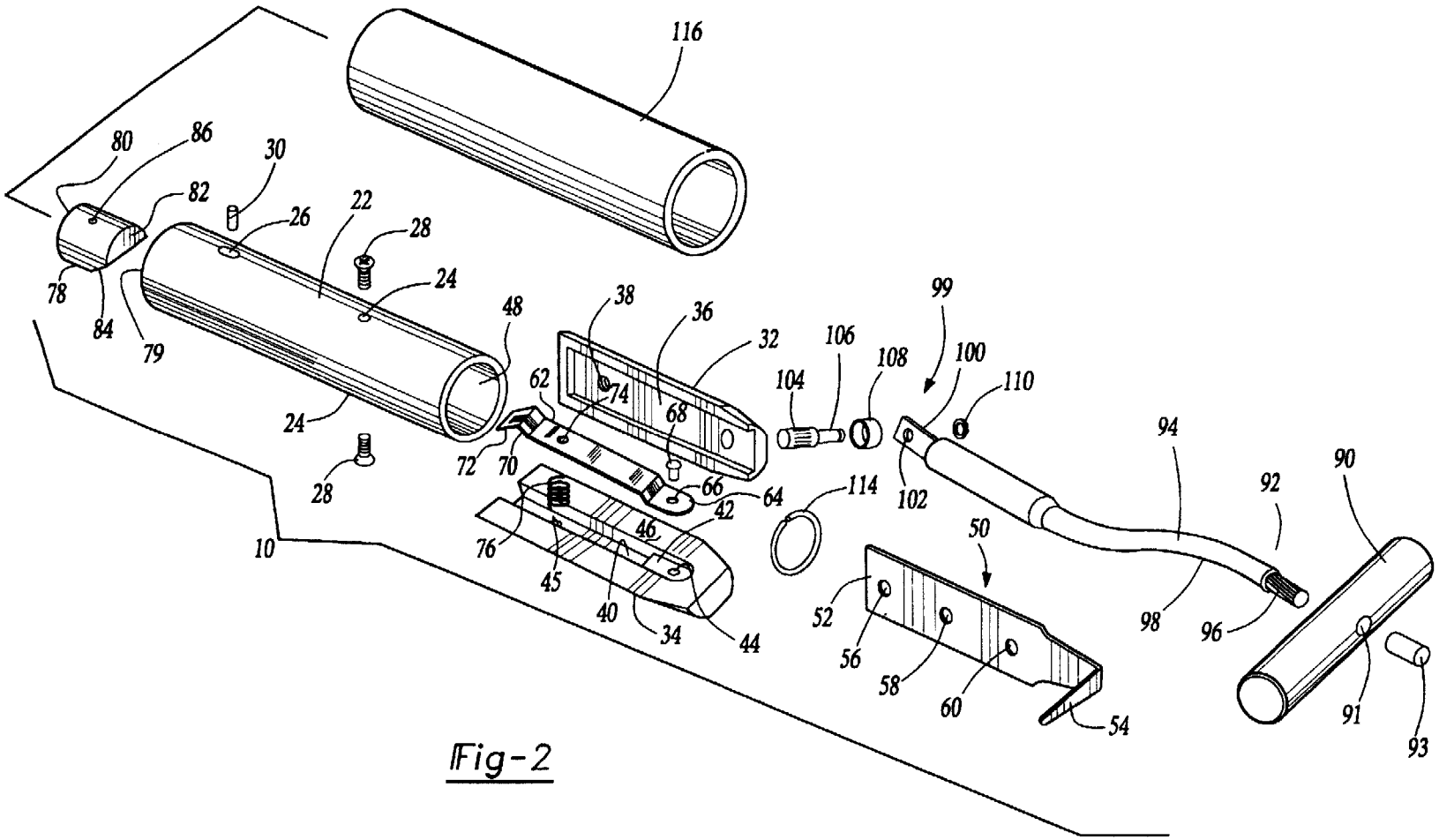
FIG. 2 is an exploded view of the components of the cutting tool according to the present invention.

Referring now to FIG. 2, an exploded view of the structural components of the cutting tool 10 of the present invention is shown and includes a cylindrically shaped body 22 constructed of a hardened material and internally hollowed. The body 22 is preferably constructed of either a lightweight metal or durable plastic or any other material exhibiting the necessary properties of durability and impact resistance. A first pair of holes 24 are formed in a top and bottom location at a first longitudinal location of the body 22 (only the upper hole 24 being visible in FIG. 2) and a second elongated channel 26 is formed in the cylindrically shaped body at a second longitudinal location. A pair of screw fasteners 28 are provided for being inserted within the upper and lower holes 24 and a pin member 30 is likewise received within the channel 26, the purpose for which will be subsequently described.

A blade housing assembly is provided and includes a first blade housing member 32 and a second blade housing member 34. The first housing member 32 has an inner longitudinally extending surface 36 which forms a longitudinally extending recessed cavity and a hole 38 is positioned at a desired position in the first member 32. The second housing member 34 likewise includes a recessed channeled inner surface 40 which forms a trough that is narrower in dimension than the surface 36 of the first mating member 32 and further includes a projecting end surface 42 located at a forward end of the channeled inner surface 40. A further aperture 44 is formed in the projecting end surface 42 and a yet further aperture 45 at a selected longitudinal location of the channeled inner surface 40. A pair of smooth-faced edge surfaces 46 extend longitudinally along the opposing face of the second mating member 34 and surround the channeled inner surface 40.

The first and second housing members 32 and 34, upon being matingly assembled together, are slidably inserted into a first selected end 48 of the cylindrically shaped body 22 so that the aperture 45 and a hidden aperture formed in an outer face of the first housing member 32 are aligned with the holes 24 in the body 22 and the fasteners 28 are then installed to fixedly mount the housing assembly in place. A longitudinally extending cavity is created within the housing assembly upon the first and second members 32 and 34 being matingly assembled together and is accounted for by the longitudinally recessed cavity defined by surface 36 in the first mating halve member 32.

A blade 50 is provided and includes a first insertable portion 52 and a second cutting portion 54 which extends preferably in a 90 degree bend fashion relative to the first insertable portion 52 and includes relatively sharpened edges for piercing the urethane seal as will be subsequently described. A plurality of apertures 56, 58 and 60 are further provided at spaced longitudinal locations along the first insertable portion 52.

A tang is provided and includes a flattened and elongated body 62 terminating at a forward end in a mounting portion 64 which extends in a recessed and parallel offset fashion relative to the elongated body 62. A further aperture 66 is formed in a generally centralized location in the mounting portion 64 and the aperture 66 and the aperture 44 of the projecting end surface 42 are aligned so that a fastener 68 secures the elongated body 62 of the tang extending longitudinally within the trough formed by the channeled inner surface 40 of the second blade housing member.

The tang terminates at a rearward end in an angled portion which includes a first bend 70 and a second and successive reverse bend 72. A button portion 74 also extends upwardly from an upper face of the elongated body 62 and is biased in an upward direction by a coil spring 76 which is mounted to an underside of the tang and which biasingly engages the channeled inner surface 40 of the second blade housing member 34.

During installation, the blade member 50 is axially inserted within the longitudinally extending cavity in first housing member 32 until a selected aperture, ideally aperture 56, of the blade 50 is aligned with the hole 38 formed in the first halve member 32 and the upwardly facing button portion 74 of the tang. The upward biasing of the tang by the coil spring 76 causes the button 74 to engage through the aperture 56 of the blade 50 and the hole 38, upon which the blade is fixedly secured within the tool.

Figure 3:
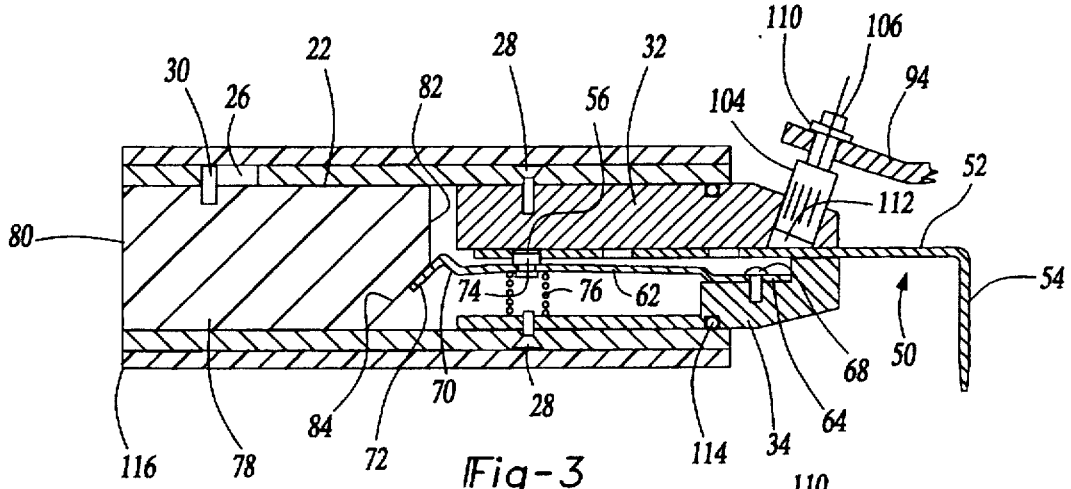
FIG. 3 is a longitudinal cutaway view of the cutting tool according to the present invention and illustrating the tool in a first blade retaining position.
Figure 4:
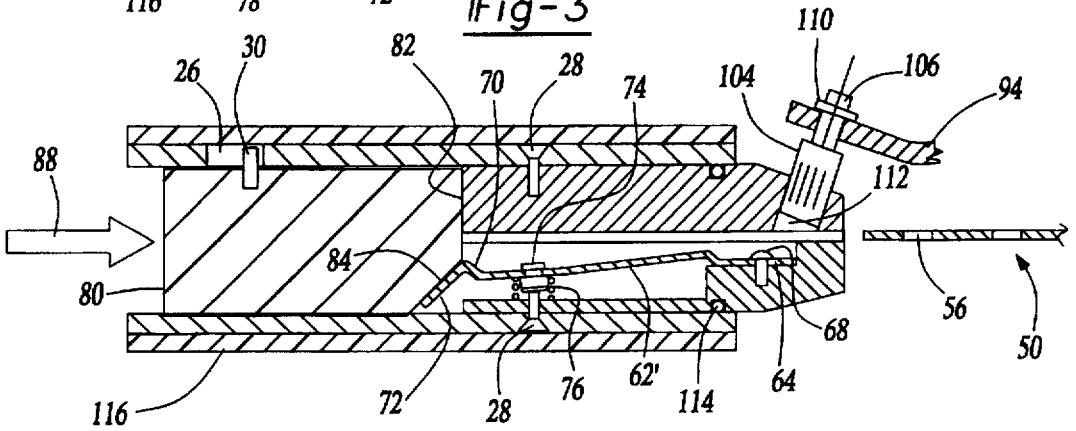
FIG. 4 is a cutaway view similar to that shown in FIG. 3 and illustrating the tool in a second blade release position.

Referring again to FIG. 2, and also to FIGS. 3 and 4, blade release means for quickly and efficiently disengaging the blade member 50 from the tool are illustrated and include a disengaging member 78 which is axially slidably mounted within a second selected end 79 of the cylindrical body 22. The disengaging member 78 includes a substantially cylindrically shaped body which is dimensioned to fit within the open end 79 of the body 22 and which includes a flat planar rear face 80 and an angled front face separated into a planar upper portion 82 and an angled lower portion 84. A further aperture 86 is formed within the member 78 in proximity to the elongated channeled 26 and the pin 30 is inserted through the channel 26 and engages the aperture 86 so that the disc is mounted within the body and is permitted a range of axially slidable motion along the rear open end 79 which is defined by the axial length of the channel 26.

As is best illustrated in the cutaway view FIG. 3, the cutting tool of the present invention is illustrated in a first blade retaining position with the reverse bend angled portion 74 at the rearward most end of the tang in operative engagement with the lower angled portion 84 of the disengaging member 78 and the upwardly biasing effect of the coil spring 76 translating in the member 78 being biased in a rearward direction by the tang. Referring now to FIG. 4, the disengaging member 78 is translated in a longitudinally rearwardly direction as identified by arrow 88 so that the lower angled portion 84 of the disengaging member 78 acts upon the angled end 74 of the tang. The tang is thus deformed downwardly in a generally cantilever fashion within the trough formed by the channeled inner surface 40 of the second blade housing member 34 as illustrated by the central elongated body at 62' and so that the button member 74 unseats from within the aperture 56 in the blade 50 and the body of the blade. In this position, the blade 50 is easily withdrawn from the cutting tool and the disengaging member 78 need only be maintained in its inwardly spaced position with the pin 30 engaged against a forward end of the elongated channel 26 until a replacement blade is slided into place with its aperture in alignment with the button member 74 and aperture 38 of the first blade housing portion. Upon insertion of the new blade, the disengaging member is released and translates rearwardly to its initial position shown in FIG. 3 with the tang undeflecting upwardly with the button member 74 to once again seat within the apertures in the blade 50 and upper housing member 32. In this manner, the blade member 50 may be quickly ejected and replaced by a similar blade in a quick and easy manner and without the need of tools, screw fasteners and the like.

Referring once again to the exploded view of FIG. 2, a gripping assembly is provided and includes a handle 90 which attaches to a first end 92 of an elongated stem 94 by a hole 91 in the handle 90 through which is inserted the first end 92 of the stem 94 and an end cap 93 which fixedly secures the handle 90 in place. The stem 94 is in a preferred embodiment constructed of a plurality of steel coils 96 which are encased within a rubberized outer coating 98 and which enable the stem 94 to withstand an extreme degree of pulling force. A second end 99 of the stem 94 includes a planar plate shaped portion 100 with an aperture 102 formed therein. Means for mounting the stem 94 to the cutting tool body are provided and include a mounting pin having a first diameter tool body engaging portion 104 and a second diameter stem mounting engaging portion 106. A collar 108 is slided over the second diameter engaging portion 106 and the end of the engaging portion 106 is inserted through the aperture 102 and engaged on an opposite face thereof by a locking washer 110 and so that the stem 94 is pivotally secured to the cutting tool body 22.

Referring again to FIGS. 3 and 4, a further recess 112 is formed at a forward end of the first blade housing member 32 and fixedly retains the body engaging portion 104 of the mounting pin so that the stem 94 and gripping handle 90 are permanently and pivotally mounted to the cutting tool and permit the user to employ both hands 18 and 20 during the sealant piercing operation as illustrated in FIG. 1. Referring again to FIGS. 2–4, additional features of the cutting tool include the provision of a circular washer element 114 which seats within a trough formed around an outer periphery of the first and second blade housing members 32 and 34 and facilitates the axially sliding insertion of the mating housing members 32 and 34 within the selected open end 48 of the cylindrical body 22. A yet further feature is provided by an elastic outer cylindrical tube 116 dimensioned to slidably engage over the cylindrical body 22 and constructed of a cushioning rubberized or like material. The purpose of the tube 116 is to provide the user's hand 18 (FIG. 1) with a non-slip grip on the cutting tool in combination with the grip exerted by the hand 20 on the handle 90 and stem 94 portions to allow for a maximum degree of cutting force to be applied by the blade portion 54 through the urethane or other sealant 12.

The present invention therefore discloses a manually operable cutting tool with a novel and unique blade release mechanism for quickly replacing the cutting blades as well as a pivotally mounted gripping assembly which enables the user to exert a maximum degree of cutting force to the tool. Additional preferred embodiments will become apparent to those skilled in the art to which it pertains without deviating from the scope of the appended claims.

I claim:

1. A cutting tool for piercing a sealant surrounding a vehicle windshield, said cutting tool comprising:

a body having a desired thickness and length;

a blade including a first insertable portion and a second cutting portion;

receptacle means located at a first selected end of said body for receiving said first insertable portion of said blade;

a gripping handle mounted to a first end of an elongate stem portion and a second end of said stem portion being pivotally secured to said body; and blade engaging means and blade release means incorporated into said body to secure said blade and to facilitate removal and replacement of said blade.

2. The cutting tool as described in claim 1, said receptacle means further comprising a first blade housing member and a second mating blade housing member, said first and second blade housing members being axially slidably inserted within said first selected end of said body and further including means for mounting within said body.

3. The cutting tool as described in claim 2, said receptacle means further comprising a longitudinally extending and recessed cavity formed in said first housing member, said first insertable portion of said blade including at least one securing aperture and being axially and slidably insertable into said cavity.

4. The cutting tool as described in claim 3, said blade engaging means and said blade release means further comprising:

a channeled inner surface formed in said second blade housing member and defining a longitudinally extending and recessed trough having a forward end and a rearward end;

a projecting end surface located at said forward end of said recessed trough and including a first aperture formed therein;

a tang having a flattened and elongated body and a forward end mounting portion, a second aperture formed in said forward end mounting portion and aligning with said first aperture in said projecting end surface for receiving a fastener for mounting said tang so as to extend longitudinally rearwardly within said recessed trough;

a first bend portion and a second succeeding and reverse bend portion extending from a rearward end of said tang; and a button portion extending from an upper face of said flattened and elongated body and a coil spring mounted to said recessed trough and contacting a lower face of said flattened and elongated body to bias said tang in an upward direction so that said button portion seats within said at least one aperture in said blade inserting portion.

5. The cutting tool as described in claim 4, said blade engaging means and said blade release means further comprising a substantially cylindrically shaped disengaging member with axially slidable engaging means within a second selected end of said body, said disengaging member including a flat planar rear surface and an angled front face including a planar upper portion and an angled planar lower portion which is in biasing engagement with said reverse bend portion of said tang, said coil spring biasingly engaging said disengaging member in a first blade retaining position.

6. The cutting tool as described in claim 5, said axially slidable engaging means further comprising an aperture in said disengaging member and a pin member mounted to and extending from said aperture, an elongated channel being formed through said cutting tool body through which said pin member extends to define a range of axially slidable motion of said disengaging member within said second selected and of said body, said disengaging member being axially slidable in an inward direction so that said angled front face biases said tang in a downward direction, causing said button member to unseat from within said at least one aperture of said blade insertable portion in a second blade release position.

7. The cutting tool as described in claim 2, said means for mounting said receptacle means within said body further comprising a first pair of holes formed through a top side and an underside of said body at a selected longitudinal location, a second pair of holes being formed in outer faces of said first and second blade housing members and being in alignment with said first pair of holes upon axial insertion of said receptacle means, a pair of mounting fasteners inserting through said aligning holes to secure said blade housing memebers in place.

8. The cutting tool as described in claim 1, said gripping handle including a centrally formed hole for receiving said stem and an end cap for mounting said stem in place, said stem further including a plurality of intertwined steel coils and a rubberized outer coating.

9. The cutting tool as described in claim 8, said second end of said stem further including a planar shaped portion with a centrally formed aperture, a mounting pin being received through a locking collar and said aperture and being engaged by a locking washer to rotatably mount said stem and gripping handle to said body.

10. The cutting tool as described in claim 1, said body further comprising a substantially cylindrical shape.

11. The cutting tool as described in claim 10, further comprising an outer cylindrical tube which is constructed of an elastic gripping surface, said outer tube being slidably engaged over said cylindrical shaped body.

* * * * *

US005784788B1

REEXAMINATION CERTIFICATE (4181st)

United States Patent [19] [11] B1 5,784,788

Cothery [45] Certificate Issued Oct. 17, 2000

[54] CUTTING TOOL FOR REMOVING A SEALANT SURROUNDING A VEHICLE WINDSHIELD

[75] Inventor: Jeffrey R. Cothery, Southfield, Mich.

[73] Assignee: Reid Manufacturing, Southfield, Mich.

Reexamination Request:
No. 90/005,351, May 7, 1999

Reexamination Certificate for:

| | |
|---|---|
| Patent No.: | **5,784,788** |
| Issued: | **Jul. 28, 1998** |
| Appl. No.: | **08/812,439** |
| Filed: | **Mar. 6, 1997** |

[51] Int. Cl.[7] ..... B26B 5/00
[52] U.S. Cl. ..... 30/294; 30/340; 279/79
[58] Field of Search ..... 30/294, 169, 339, 30/340; 279/76, 77, 79

[56] References Cited

PUBLICATIONS

Equalizer Industries, Inc., *1991 Catalog,* vol. 145, pp. cover, 10, and 11.

Autoglass, *1995 Industry Forecast: Computer Software,* 6(1), Jan./Feb. 1995, pp. cover and 6.

Equalizer Industries, Inc., *1996 Catalog,* pp. cover, 11, 12, 13, and 39.

Equalizer Industries, Inc., *1992 Catalog,* pp. cover and 12.

Sommer & Maca, *General Catalog No. 25,* pp. cover, inside cover, and 74.

*Primary Examiner*—Douglas D. Watts

[57] ABSTRACT

A cutting tool for piercing a sealant surrounding a vehicle windshield including a cylindrically shape body which is internally hollowed and first and second blade housing members which, upon assembly, are axially slidably mounted within a first selected end of the body and form a blade receiving cavity. A blade includes a first insertable portion with at least one aperture and a second cutting portion extending at a desired angle with respect to the insertable portion. A spring loaded tang is mounted within the second blade housing member and is upwardly biased so that an upwardly projecting button portion engages through the at least one aperture of the blade insertable portion in a first blade retaining position. An inwardly displaceable disengaging member is axially slidably mounted within a second selected end of the body and is contoured along a forward face so that it unseats the spring loaded from the blade aperture in a second blade release position.

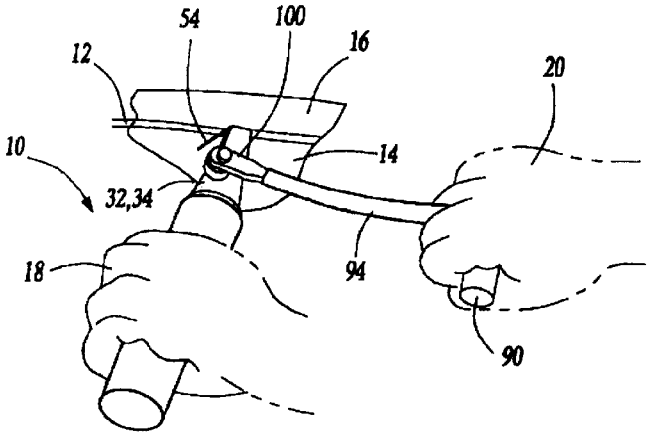

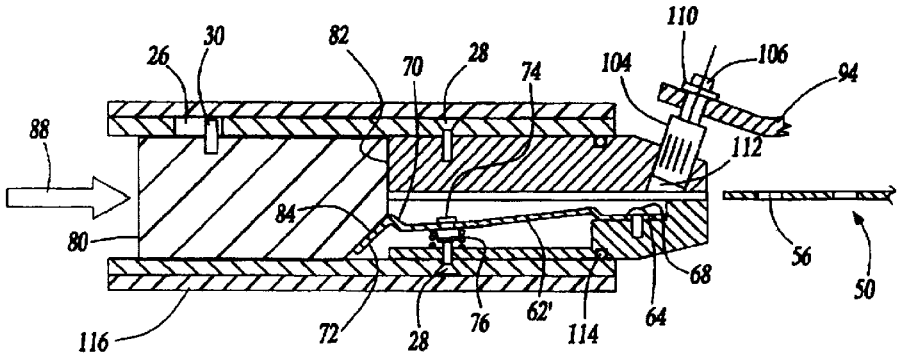

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 2 is cancelled.

Claims 1, 3 and 7 are determined to be patentable as amended.

Claims 4–6 and 8–11, dependent on an amended claim, are determined to be patentable.

New claims 12 and 13 are added and determined to be patentable.

1. A cutting tool for piercing a sealant surrounding a vehicle windshield, said cutting tool comprising:

a body having a desired thickness and length;

a blade including a first insertable portion and a second cutting portion;

receptacle means located at a first selected end of said body for receiving said first insertable portion of said blade*, said receptacle means further comprising a first blade housing member and a second blade housing member, said first and second blade housing members being axially slidably inserted within said first selected end of said body and further including means for mounting within said body*;

a gripping handle mounted to a first end of an elongate stem portion and a second end of said stem portion being pivotally secured to said body; and blade engaging means and blade release means incorporated into said body to secure said blade and to facilitate removal and replacement of said blade.

3. The cutting tool as described in claim [2] *1*, said receptacle means further comprising a longitudinally extending and recessed cavity formed in said first housing member, said first insertable portion of said blade including at least one securing aperture and being axially and slidably insertable into said cavity.

7. The cutting tool as described in claim [2] *1*, said means for mounting said receptacle means within said body further comprising a first pair of holes formed through a top side and an underside of said body at a selected longitudinal location, a second pair of holes being formed in outer faces of said first and second blade housing members and being in alignment with said first pair of holes upon axial insertion of said receptacle means, a pair of mounting fasteners inserting through said aligning holes to secure said blade housing [memebers] *members* in place.

*12. A cutting tool for piercing a sealant surrounding a vehicle windshield, said cutting tool comprising:*

*a body having a desired thickness and length;*

*a blade including a first insertable portion and a second cutting portion;*

*receptacle means located at a first selected end of said body for receiving said first insertable portion of said blade;*

*a gripping handle mounted to a first end of an elongate stem portion and a second end of said stem portion being pivotally secured to said body, said gripping handle including a centrally formed hole for receiving said stem and an end cap for mounting said stem in place, said stem further including a plurality of intertwined steel coils and a rubberized outer coating; and*

*blade engaging means and blade release means incorporated into said body to secure said blade and to facilitate removal and replacement of said blade.*

*13. A cutting tool for piercing a sealant surrounding a vehicle windshield, said cutting tool comprising:*

*a body having a substantially cylindrical shape with a desired thickness and length, said body further comprising an outer cylindrical tube which is constructed of an elastic gripping surface, said outer tube being slidably engaged over said cylindrical shaped body;*

*a blade including a first insertable portion and a second cutting portion;*

*receptacle means located at a first selected end of said body for receiving said first insertable portion of said blade;*

*a gripping handle mounted to a first end of an elongate stem portion and a second end of said stem portion being pivotally secured to said body; and*

*blade engaging means and blade release means incorporated into said body to secure said blade and to facilitate removal and replacement of said blade.*

* * * * *